US006469287B1

(12) United States Patent
Kim

(10) Patent No.: US 6,469,287 B1
(45) Date of Patent: Oct. 22, 2002

(54) COMBINATION VENTILATED HOOD AND MICROWAVE OVEN

(75) Inventor: Gi Young Kim, Kyungsannam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/642,150

(22) Filed: Aug. 21, 2000

(30) Foreign Application Priority Data

Aug. 21, 1999 (KR) ..... 99-34841
Dec. 20, 1999 (KR) ..... 99-59238

(51) Int. Cl.[7] ..... H05B 6/74; H05B 6/78

(52) U.S. Cl. ..... 219/751; 219/754; 219/756; 219/757; 219/762

(58) Field of Search ..... 219/751, 753, 219/754, 757, 762, 763, 756

(56) References Cited

U.S. PATENT DOCUMENTS

| | | | | |
|---|---|---|---|---|
| 3,991,295 A | * | 11/1976 | Akiyoshi | 219/751 |
| 4,286,134 A | * | 8/1981 | Nakata et al. | 219/751 |
| 4,296,297 A | * | 10/1981 | Miller | 219/757 |
| 4,334,137 A | * | 6/1982 | Takagi et al. | 219/751 |
| 4,743,728 A | * | 5/1988 | Nagafusa | 219/751 |
| 6,013,909 A | * | 1/2000 | Aramaki et al. | 219/751 |

FOREIGN PATENT DOCUMENTS

| | | | | |
|---|---|---|---|---|
| JP | 52-11442 | * | 1/1977 | 219/751 |
| JP | 53-122948 | * | 10/1978 | 219/751 |
| JP | 53-148748 | * | 12/1978 | 219/751 |
| JP | 57-210226 | * | 12/1982 | 219/754 |
| JP | 1-167531 | * | 7/1989 | 219/754 |
| JP | 2-10024 | * | 1/1990 | 219/751 |
| JP | 2-18889 | * | 1/1990 | 219/751 |
| JP | 4-9529 | * | 1/1992 | 219/754 |

* cited by examiner

*Primary Examiner*—Philip H. Leung
(74) *Attorney, Agent, or Firm*—Birch, Stewart, Kolasch & Birch, LLP

(57) ABSTRACT

A combination microwave ventilated hood cooking system including a microwave oven with a cooking cavity; a magnetron for generating microwaves located adjacent the cooking cavity; and cooling fan outside the cooking cavity. The cooking cavity including at least two trays of different shapes and a stirrer for dispersing microwaves in the cooking cavity. A guide is between the stirrer and the cooling fan such that the guide has a downward slope from the cooling fan to the stirrer. During operation of the microwave, the cooling fan creates an air current, which is directed to the stirrer by the guide and drives the stirrer to disperse microwaves in the cooking cavity and direct an air current to cool the magnetron.

20 Claims, 4 Drawing Sheets

COMBINATION VENTILATED HOOD AND MICROWAVE OVEN

BACKGROUND OF THE INVENTION

1. Field of the Invention

The present invention relates to a combination ventilated hood and microwave oven, and more particularly, to a combination ventilated hood and microwave oven having a plurality of trays by which a large quantity of food is cooked at the same time.

2. Description of the Background Art

A general combination microwave oven and ventilated hood has a function of suctioning steam and smoke generated during the operation of a gas oven range positioned at a lower portion of the microwave oven.

The interior of a combination ventilated hood and microwave oven in the conventional art, as illustrated in FIG. 1, includes a cavity 102, which is a cooking space for cooking foodstuffs by microwaves oscillated from a magnetron 106. Usually, since the cavity 102 of the combination ventilated hood and microwave oven is installed across the width of an upper portion of the gas oven range, the horizontal length L of the cavity 102 is large as compared to the general stand alone microwave oven. Also, an exhaust motor 104 is installed in the cavity 102 to exhaust steam and smoke.

At the bottom surface of the cavity 102, a circular rotary tray 108 for putting foodstuffs to be cooked on the top surface thereof, is installed. In addition, a rotary tray mounting unit 107 is connected to a lower portion of the rotary tray 108 so that the rotary tray 108 is mounted for rotation.

The rotary tray mounting unit 107 is positioned at the bottom surface of the cavity 102 and includes a driving source 103 with a power transmission device for rotating the rotary tray 108.

However, in the conventional combination ventilated hood and microwave oven, the rotary tray 108 is installed at the center portion of the bottom surface of the cavity 102, and the rotary tray mounting unit 107 for rotating the rotary tray 108 is also installed at a lower side of the center portion of the bottom surface of the cavity 102.

Namely, in the conventional ventilated hood and microwave oven, although the horizontal length L of the cavity 102 is large as compared to the general microwave oven, the rotary tray 108 is mounted at the central portion of the cavity 102 in the same manner as the general microwave oven.

Therefore, in the conventional microwave oven and ventilated hood, the right and left side portions of the rotary tray in the cavity are not used as a cooking space. Also, although the size of the inner space of the cavity is large as compared to the general microwave oven, the actual space for putting foodstuffs thereon for cooking purposes has the same size as the general microwave oven, resulting in an inefficient use of the cooking space.

Meanwhile, as illustrated in FIG. 2, another microwave structure according to the conventional art is disclosed. The structure includes a first tray 210 and a second tray 220 each having a smaller size than the above-described rotary tray. The first tray 210 is installed at one side of the rotary tray (not shown) and the second tray 220 is installed on the other side of the rotary tray. Both the first tray 210 and the second tray 220 are to be driven by a motor 330 for driving the rotary tray.

Also, the structure includes a main gear 201 connected to the motor 330 for driving the rotary tray; a first slave gear 211 for driving the first tray 210 engaged with the main gear 201; a second slave gear 221 for driving the second tray 220 is engaged with the main gear 201 and opposite the first slave gear 211; and the axis of the motor 310 extends from the motor through the main gear 201. Further, although not shown, the structure has a third tray.

However, although the above-described structure can have three trays, the rotary tray alone is driven during actual operation of the microwave oven. As illustrated in FIG. 2, only the first tray 201 and the second tray 202 must be driven in a state where the rotary state is escaped to the outside of the main frame. Consequently, there occurs a problem that the manufacturing cost is increased, and the space of a cooking chamber is not efficiently used.

Meanwhile, FIG. 3 illustrates still another structure according to the conventional art. The structure includes a stirrer fan 312 driven by the motor 307 is installed at one side of the rotary tray 305, and a base plate 319 on which a container 318 for containing a temperature probe 320 can be put on is installed at an upper side of the stirrer fan 312. Thereby, it is possible to simultaneously carry out cooking using the rotary tray 305 and cooking using the temperature probe 320.

The driving structure of the stirrer fan 312 driven by the motor 307 will now be described. The rotating shaft 306 of the rotary tray 305 is connected to the rotating shaft 308 of the motor 307. A pulley 314 fixed to the rotating shaft 313 of the stirrer fan 312 and a pulley 315 fixed to the rotating shaft 308 of the motor 307 are connected with a belt 316, thereby making it possible for the stirrer fan 312 to be driven by the motor 307.

In addition, a wave guide 317 for transmitting microwaves generated from the magnetron 309 to the stirrer fan 312 is installed at one side wall of the cavity 302, while a shelf-shaped base plate 319 for putting the temperature probe 320 on the top surface thereof is positioned at an upper side portion of the stirrer fan 312 at one side of the rotary tray 305. Reference numeral 321 designates a bracket for fixing the motor.

However, in addition to the wave guide 310 installed at an upper portion of the cavity 302, the wave guide 317 has to be installed in order to transmit microwaves to the stirrer fan 312 positioned at a lower portion of the cavity 302. Thus, the wave guide must be longer and accordingly increases the manufacturing cost.

In addition, the bottom surface of the base plate 319 is positioned higher, than the bottom surface of the rotary tray 305. Thus, making it inconvenient to clean the microwave oven and aggravating the aesthetic appearance of the microwave oven.

In addition, since the pulleys and belt are required for driving the stirrer fan, the manufacturing cost is increased. In particular, the diameter ratio of the pulley fixed to the rotating shaft of the motor for properly rotating the stirrer fan for cooking purposes to the pulley fixed to the rotating shaft of the stirrer fan must be increased, thus making the manufacturing process complicated and increasing the manufacturing cost.

SUMMARY OF THE INVENTION

Accordingly, it is an object of the present invention to provide a combination ventilated hood microwave oven having a plurality of trays and able to cook a large quantity of food at one time by making the most of a cooking space of the combination ventilated hood and microwave oven.

It is another object or me present invention to provide a combination ventilated hood and microwave oven having a plurality of trays by which microwaves supplied into a cavity can be uniformly penetrated through foodstuffs to be cooked.

To achieve the above objects, there is provided a combination microwave oven and ventilated hood having a plurality of trays which includes: a stirrer fan installed at an upper portion of the cavity at which the plurality of trays are installed; a coding fan installed at an upper portion of a machine chamber formed at one side of the cavity; and a guide unit for guiding parts of an airflow generated from the cooling fan towards the stirrer fan. Additional advantages, objects and features of the invention will become more apparent, from the description which follow.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
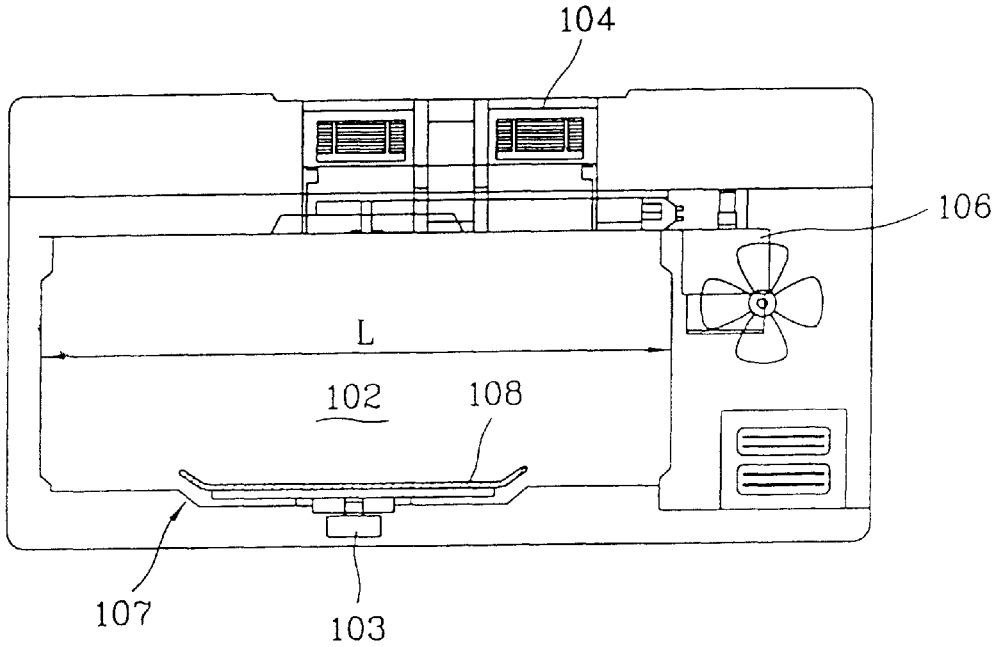
FIG. 1 CONVENTIONAL ART
FIG. 1 depicts a cross-sectional view of a combination ventilated hood and microwave oven according to the conventional art.
Figure 2:
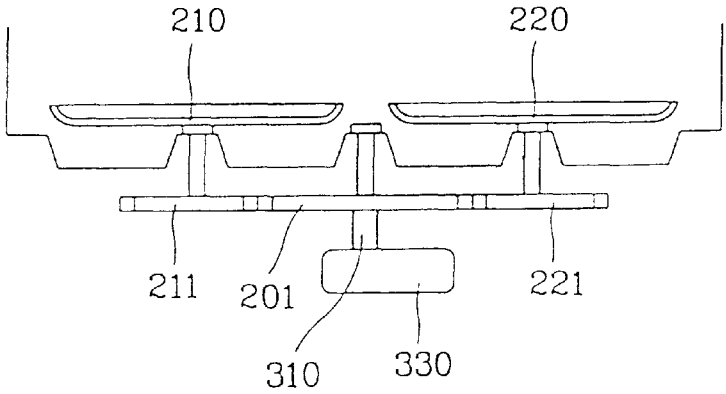
FIG. 2 CONVENTIONAL ART
FIG. 2 depicts a partial cross-sectional view of another example of a combination ventilated hood and microwave oven according to the conventional art.
Figure 3:
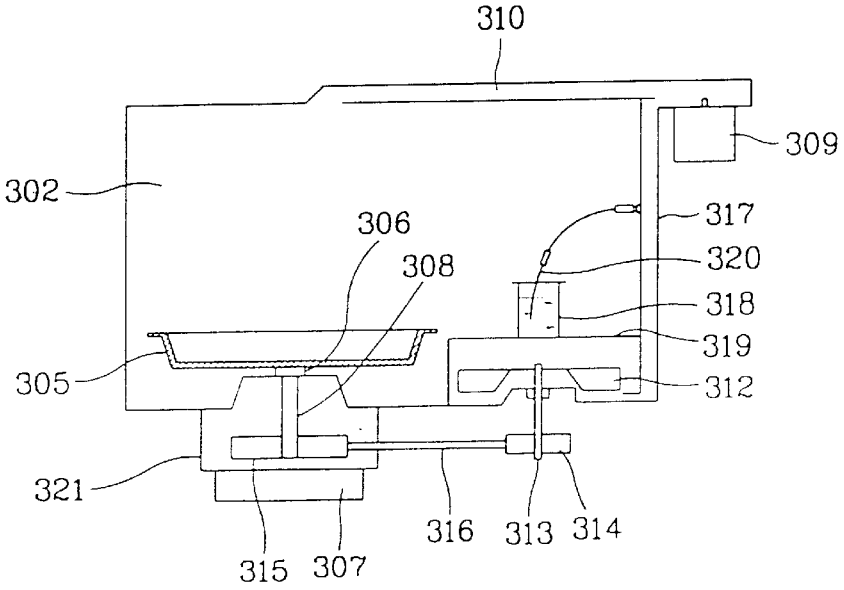
FIG. 3 CONVENTIONAL ART
FIG. 3 depicts a partial cross-sectional view of still another example of a combination microwave oven and ventilated hood according to the conventional art.
Figure 4:
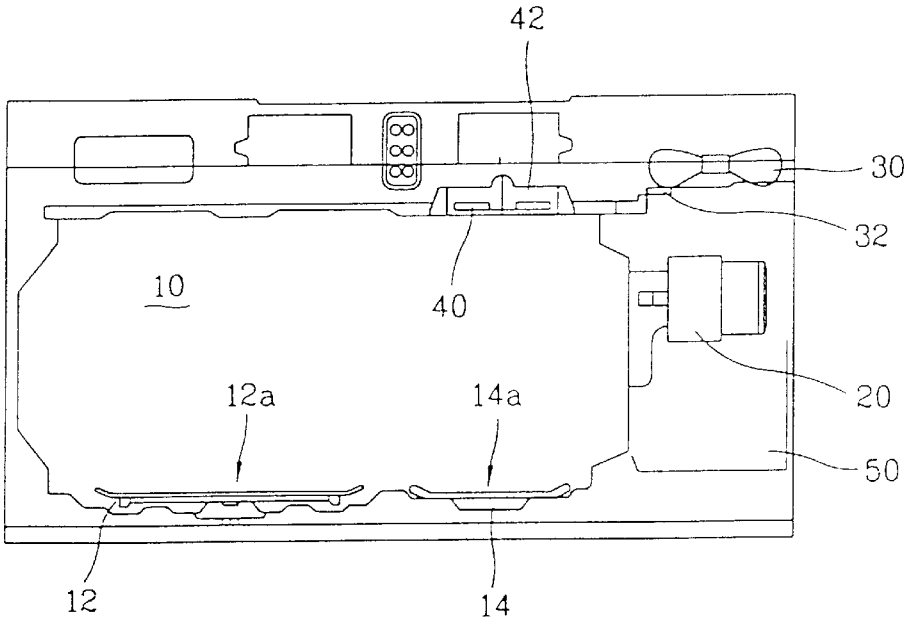
FIG. 4 depicts a cross-sectional view of a combination ventilated hood and microwave oven having a plurality of trays according to a first embodiment of the present invention.

The present invention includes a combination ventilated hood and microwave oven. As depicted in FIG. 4, the microwave oven includes a first tray mounting unit 12 for putting a first tray 12*a* on the top surface thereof and a second tray mounting unit 14 for putting a second tray 14 on the top surface thereof are installed.

The first tray mounting unit 12 is installed at a side portion in the cavity 10, for example, at a position most adjacent to the utmost left side in the cavity 10. The second tray mounting unit 14 is installed at the other side portion in the cavity 10, for example, at a position most adjacent to the utmost right side in the cavity 10.

In addition, the first tray mounting unit 12 and the second tray mounting unit 14 are positioned at a space formed on the bottom surface of the cavity 10, respectively.

Figure 5:
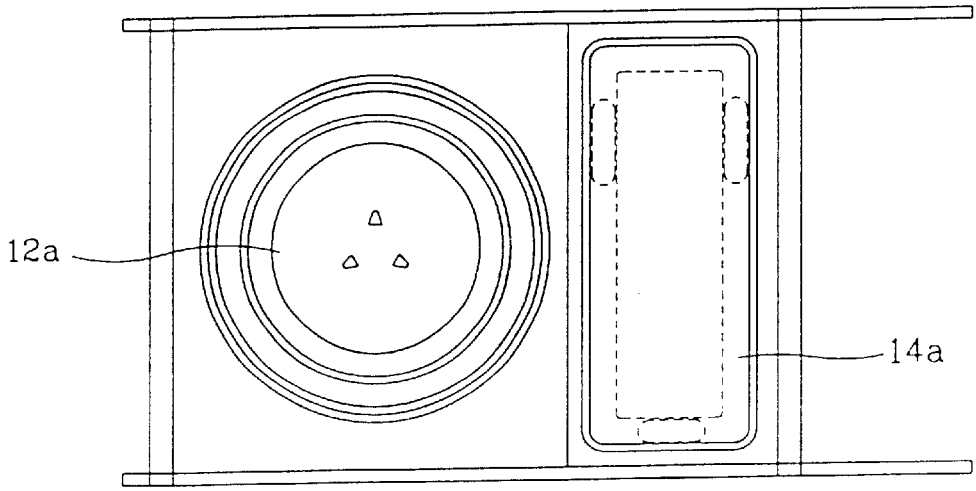
FIG. 5 depicts a top cross-sectional view of, the combination ventilated hood and microwave oven according to the first embodiment of the present invention as depicted in FIG. 4.
Figure 6:
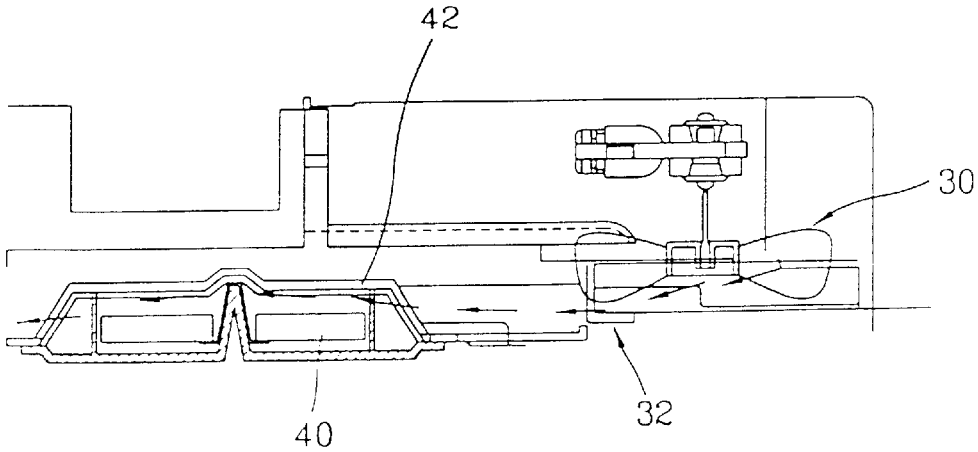
FIG. 6 depicts part of the construction of the combination ventilated hood and microwave oven having a plurality of trays according to the first embodiment of the present invention.
Figure 7:
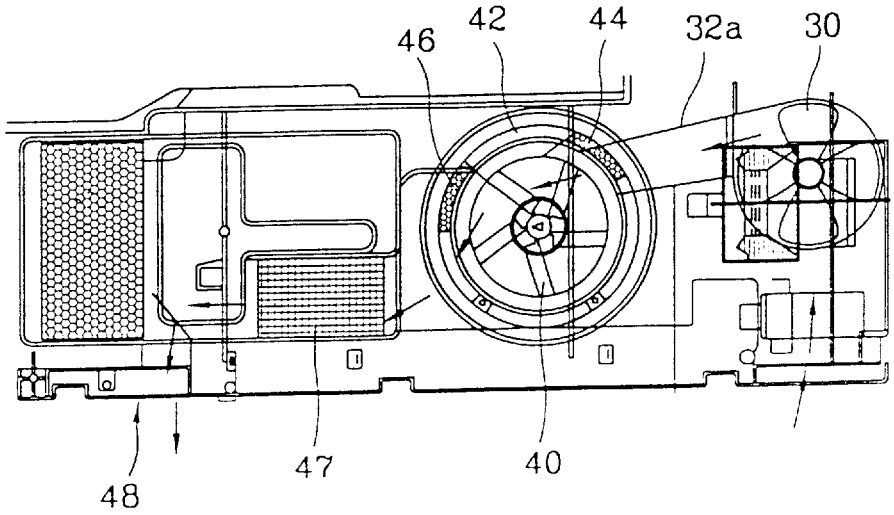
FIG. 7 depicts a partial vertical cross-sectional view of the construction of a driving apparatus for the combination ventilated hood and microwave oven having a plurality of trays according to the first embodiment of the present invention.

In a first embodiment of the present invention, as illustrated in FIG. 5, the first tray mounting unit 12 is installed so that the first tray 12*a* of a circular shape can be mounted, and is constructed so that the first tray 12*a* is rotatable during operation of the microwave oven. Additionally, the first tray mounting unit 12 includes a driving source for rotating the first tray 12*a* and a power transmission device for transmitting power from the driving source to the tray.

That is, according to the first embodiment of the present invention, the first tray 12*a* is constructed as a circular tray that can be rotated by the first tray mounting unit 12, which is of similar construction to a general microwave oven.

Meanwhile, in the first embodiment of the present invention, the second tray 14*a* is formed in a rectangular shape, and is constructed in such a manner that it is fixed to the second tray mounting unit 14.

That is, in the cavity 10, the second tray 14*a* is connected to an upper portion of the second tray mounting unit 14 and maintained in a fixed state where it is not rotated during the operation of the microwave oven. Therefore, foodstuffs put on an upper portion of the second tray 14*a* are cooked without rotation.

Also, in the combination microwave oven and ventilated hood of the present invention, a stirrer fan 40 for dispersing microwaves to be uniformly penetrated through foodstuffs when the microwaves oscillated from a magnetron 20 are introduced into the cavity 10 through a wave guide (not shown) is installed at the. upright upper portion of the second tray 14*a*.

That is, the foodstuffs put on the top surface of the second tray 14*a* can be also uniformly cooked by the stirrer fan 40.

Figure 8:
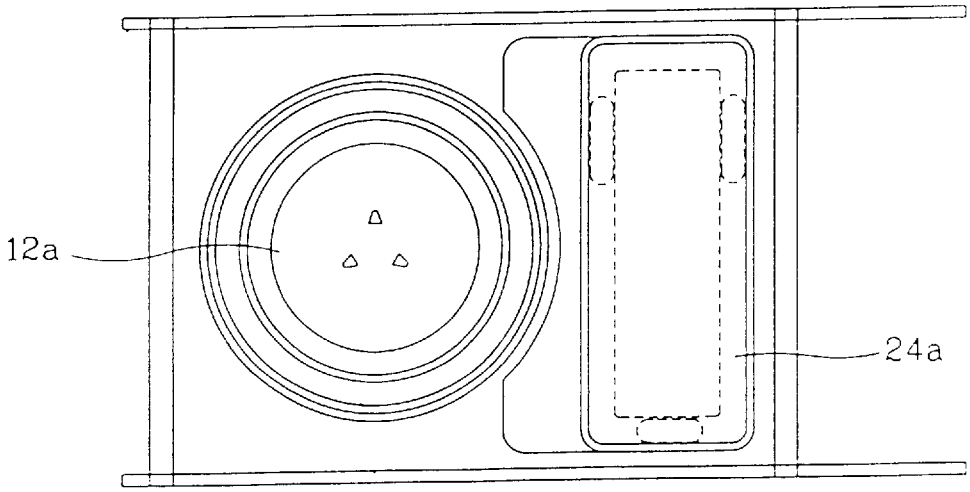
FIG. 8 depicts a top cross-sectional view of a combination microwave oven and ventilated hood having a plurality of trays according to a second embodiment of the present invention.

In the second embodiment of the present invention, as illustrated in FIG. 8, the second tray 24 is a non-square shape, and can be formed to have a large area in a predetermined shape within the range where it does not contact the first tray 12*a*. Further, the second tray 24 is installed to be rotatable during operation of the microwave oven, and the first tray 12*a* is installed in a fixed state during the operation of the microwave oven.

Hereinafter, the construction of the present invention is described in more detail, in particular, with respect to the stirrer fan 40.

The stirrer fan 40 used in the combination ventilated hood and microwave oven having a plurality of trays of the present invention is not constructed to be rotated by a motor, but rather to be rotated by using parts of the flow of cooling air generated from the interior of the microwave oven.

As illustrated in FIG. 4, the magnetron 20 for supplying microwaves into the cavity 10 in which foodstuffs to be cooked is installed at a machine chamber 50 positioned at one side of the cavity 10.

In addition, a cooling fan 30 for generating an air flow in order to cool the magnetron 20 and a high pressure trans (not shown) is installed at an upper portion of the machine chamber 50.

In addition, the stirrer fan 40 is installed on the top surface of the cavity 10 adjacent to the machine chamber 50. In detail, the stirrer fan 40 is installed to be rotatable at the inner side of a fan housing 42, which is formed concave toward an upper portion of the case of the microwave oven on the top surface of the cavity 10.

Accordingly, parts of an air flow generated by driving the cooling fan 30 to cool the magnetron 20 during operation of the microwave oven are guided towards the stirrer fan 40 for thereby driving the stirrer fan 40.

At one side surface of the fan housing 42, a plurality of air vents are formed so that air blowing from the cooling fan 30 can be passed through them.

Hereinafter, the construction for driving the stirrer fan 40 will be described.

As illustrated in FIG. 4, the cooling fan 30 installed at an upper end portion of the machine chamber 50 is installed higher than the stirrer fan 40.

More specifically, at a lower portion of the cooling fan 30, a guide 32 is extended to a part of the circumference of the cooling fan 30 in order to guide parts of the air flow generated from the cooling fan 30. The air flow having collided with the guide 32 is guided through the interior of a guide duct 32*a* air-permeably connected to the guide 32.

Continuously, the air flow guided through the interior of the guide duct 32*a* is introduced towards the stirrer fan 40 through the air vents 44 formed at one side surface of the fan housing 42, and is contacted by the stirrer fan 40. Thereby, the stirrer fan 40 is rotated.

The air flow that has rotated the stirrer fan 40 is discharged through the air vents 46 formed on the other side surface of the fan housing 42.

In this manner, the air discharged through the fan housing 42 is mixed with air exhausted from a first exhaust unit 47 for exhausting air in the cavity 10, and then is completely exhausted through a second exhaust unit 48 of a front grill of the combination ventilated hood and microwave oven.

Regarding the overall air flow formed according to the present invention, the air flow generated from the cooling fan 30 forms an air flow at least as far as the stirrer fan 40, and thus, from a relatively upper position to a relatively lower position.

That is, in the present invention, because the cooing fan 30 is installed higher than the stirrer fan 40, there is no portion moving upwardly in the path of the air flow guided from the cooling fan 30 to the stirrer fan 40, resulting in decrease of energy toss due to path resistance. Therefore, the air flow colliding with the stirrer fan 40 has a high potential energy, and thus it is possible to rotate the stirrer fan 40 by much stronger power.

As described above, in the combination ventilated hood and microwave oven having a plurality of trays, a large quantity of food can be cooked at one time by making the most efficient use of a cooking space. Thereby, the overall cooking time is reduced.

Consequently, a wide variety of pairs of dishes can be cooked (for example, simultaneous warming up of bread and milk).

In addition, microwaves are uniformly penetrated through food put on a non-rotating tray without any additional motor during operation of the microwave oven. Thereby, the manufacturing cost and occurrence of failures of the microwave oven are reduced.

In addition, the cooling fan 30 is installed higher than the stirrer fan 40, and accordingly the energy loss due to path resistance can be reduced, thereby reducing the maintenance cost during the operation of the microwave oven.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalencies of such meets and bounds are therefore intended to be embraced by the appended claims.

What is claimed is:

1. A combination ventilated hood and microwave oven system comprising:

a cooking cavity in the microwave oven and having a first exhaust unit for exhausting air therein;

a cooling fan installed in the microwave oven and separate from the cooking cavity;

a magnetron located adjacent the cooking cavity, the magnetron being operable to generate microwaves, the magnetron being cooled by a first airflow generated by the cooling fan;

a housing located on a top surface of the cooking cavity and having air vents;

a stirrer rotatably mounted in the housing;

a guide connected between the cooling fan and the housing for directing a second airflow from the cooling fan to the housing, the guide sloping downwardly from the cooling fan to the housing, the guide directing the second airflow from the cooling fan separately from the first air flow cooling the magnetron, for driving the stirrer; and a second exhaust unit for exhausting air discharged through the first exhaust unit and the air vents of the housing.

2. The system of claim 1, wherein the cooling fan is installed at a position relatively higher than the stirrer.

3. The system of claim 1, wherein the stirrer directs the air current to disperse the microwaves in the cooking.

4. The system of claim 1, wherein a machine chamber is separated from the cooking cavity in the microwave oven and the cooling fan is located at a position relatively higher than the magnetron in the machine chamber to cool the magnetron.

5. A microwave oven system comprising:

a cooking cavity in the microwave oven;

a magnetron located adjacent the cooking cavity, the magnetron being operable to generate microwaves;

at least two. trays laterally adjacent to each other and in the cooking cavity;

at least two depressions formed into a lower surface of the cooking cavity, the depressions:creating tray mounting areas;

a drive positioned in a first tray mounting area, the drive for rotating a first tray of the at least two trays; and a stirrer located directly above a non-rotating second tray of the at least two trays and dispersing the microwaves in the cooking cavity.

6. The system of claim 5, wherein the first tray is shaped differently than the second tray.

7. The system of claim 6, wherein the first tray is circular and the second tray is polygonal.

8. The system of claim 5, wherein the trays are laterally adjacent and do not contact each other.

9. A combination ventilated hood and microwave oven system comprising:

a cooking cavity in the microwave oven, the cooking cavity having at least two trays;

a magnetron located adjacent the cooking cavity, the magnetron generating microwaves;

a stirrer located on a top surface of the cooking cavity and dispersing the microwave in the cooking cavity;

a cooling fan installed in the microwave oven and outside the cooking cavity;

a guide connected between the cooling fan and the stirrer such that the guide has a downward slope from the cooling fan to the stirrer;

at least two tray mounting areas formed in the lower surface of the cooking cavity;

a drive positioned in a first tray mounting area of the at least two tray mounting areas, the drive being capable of rotating a tray;

a first tray placed over the drive; and a second tray placed over a second tray mounting area of the at least two tray mounting areas, said second tray mounting area being without provision of a drive, wherein the drive rotates. the first tray during operation of the microwave oven and the second tray remains fixed.

10. The system of claim 9, wherein the at least two trays includes a first tray and a second tray having different shapes.

11. The system of claim 10, wherein the first tray is circular and the second tray is polygonal.

12. The system of claim 11, wherein the second tray is rectangular.

13. The system of claim 9, wherein the trays are not in contact with each other.

14. The system of claim 9, wherein the cooling fan is installed at a position relatively higher than the stirrer.

15. The system of claim 9, further comprising:

a machine chamber separate from the cooking cavity, the chamber containing the cooling fan.

16. The system of claim 9, wherein:

the guide does not have a portion with an upward slope from the cooling fan to the stirrer.

17. The system of claim 9, wherein the stirrer is located directly above the second tray.

18. The system of claim 9, wherein the magnetron is not within the path of the air from the cooling fan to the stirrer.

19. The system of claim 9, further comprising:

a first exhaust unit formed on the cooking cavity, for exhausting air in the cooking cavity; and a second exhaust unit for exhausting air discharged through the first exhaust unit and the stirrer.

20. The system of claim 9, wherein the stirrer is enclosed in a housing.

* * * * *